US012492555B2

(12) United States Patent
Pomey

(10) Patent No.: US 12,492,555 B2
(45) **Date of Patent: *Dec. 9, 2025**

(54) PROTECTIVE DEVICE FOR PROTRUDING OBJECTS

(71) Applicant: Christopher Michael Pomey, Medina, MN (US)

(72) Inventor: Christopher Michael Pomey, Medina, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/439,642

(22) Filed: Feb. 12, 2024

(65) Prior Publication Data

US 2024/0410170 A1 Dec. 12, 2024

Related U.S. Application Data

(63) Continuation of application No. 17/590,675, filed on Feb. 1, 2022, now Pat. No. 11,898,352.

(60) Provisional application No. 63/206,139, filed on Feb. 1, 2021.

(51) Int. Cl.
*E04C 5/16* (2006.01)
*E04G 21/32* (2006.01)

(52) U.S. Cl.
CPC ..... *E04C 5/161* (2013.01); *E04G 21/32* (2013.01)

(58) Field of Classification Search
CPC ..... E04C 5/161; E04G 21/32
See application file for complete search history.

(56) References Cited

U.S. PATENT DOCUMENTS 5,613,336 A * 3/1997 Workman ..... E04G 21/3252 52/301
5,729,941 A * 3/1998 Kassardjian ..... E04G 21/32 52/301
5,943,836 A * 8/1999 Kassardjian ..... E04G 21/32 52/300
6,085,478 A * 7/2000 Workman ..... B65D 59/06 52/300
6,662,514 B2 * 12/2003 Workman ..... E04G 21/32 52/301
7,472,522 B2 * 1/2009 Yang ..... E04F 15/02488 52/301
8,141,309 B2 * 3/2012 Kubicek ..... E04C 5/161 52/301
10,508,447 B2 * 12/2019 Mathews ..... E04C 5/122
10,822,799 B2 * 11/2020 Ryan ..... E04C 5/161

* cited by examiner

*Primary Examiner* — Adriana Figueroa
(74) *Attorney, Agent, or Firm* — Inovue Advisors, LLC

(57) ABSTRACT

A protective device to reduce risk of injury from a protruding object a base member has a first surface adapted to face outward from the protruding object and a second surface adapted to face inward toward the protruding object. A first sidewall defines a space. The first sidewall has a first end connected to the second surface of the base member and a second end, which includes an opening adapted to receive the protruding object. The first sidewall extends perpendicularly from the base member. At least one fin is positioned within the first space. A second sidewall defines a second space. At least one finger is positioned within the second space. The at least one finger is connected to and extends from the second sidewall into the second space.

18 Claims, 8 Drawing Sheets

PROTECTIVE DEVICE FOR PROTRUDING OBJECTS

CROSS REFERENCE TO RELATED APPLICATIONS

The present application claims priority to U.S. patent application Ser. No. 17/590,675, which claims priority to U.S. Provisional Application No. 63/206,139, which are each hereby incorporated by reference in their entirety.

BACKGROUND OF THE INVENTION

The present application relates generally to a protective device that can be placed over a protruding object, and more specifically to a protective device that can be placed over a protruding object to prevent injury to those contacting the protruding object.

Protruding objects are of particular concern throughout the physical world due to their ability to damage people and things that may collide with them. Sometimes protruding objects are blunt and impart a blunt force to persons or things that collide with them. Other times, a protruding object may be rod shaped or have a pointed end that could puncture or impale a person or thing colliding with it. There are many construction materials and tools that fit in these categories. There is a risk that when storing these materials, or staging them for use in a project, that people or things may inadvertently collide with these materials and receive serious injuries as a result.

In order to prevent such injuries, customs and regulations have developed over the years specifying the conditions and manner under which certain materials and tools can be stored. One example relates to rebar. Rebar is a steel reinforcing rod that is used in the construction of concrete structures. The rods comprising rebar are sufficiently strong, and narrow in profile, that a person or thing colliding with a rebar rod could receive an impalement injury. In order to lessen the preceding risk, regulations have developed around the storage and deployment of rebar rods. For example, OSHA standard 1926.701(b) states "all protruding reinforcing steel, onto and into which employees could fall, shall be guarded to eliminate the hazard of impalement".

Poles and fence posts are also dangerous for the same reasons as rebar rods. Many warehouses and manufacturing facilities store objects that present impalement risk. For instance, various shafts, axles, and auguring devices may project a dangerous profile. These also require some form of protection from impalement risks, either due to regulations or through the custom of providing mechanisms to guard the safety of others.

One mechanism that is used to mitigate impalement by such is to place a cap over any end that may cause impalement. FIG. 1 shows an arrangement in which several rebar rods 1 are protruding upward. A cap 3 is placed on the ends of each rod 1 in order to eliminate or mitigate impalement risk. When the rebar is ready to be employed in a project. the caps 3 are removed from the rods. Concrete is then poured around the rods 1 and any impalement risk is eliminated because there is no longer an exposed end. Similar approaches have been taken with respect to other protruding objects.

The problem with the preceding approach is that protruding objects come in many sizes and shapes. For example, rebar of one size require a cap of a certain size while rebar of another size requires a cap of a different size. Mismatching caps to rebar will not work because if a cap is too small for one size of rebar, then it will not fit over it. If the cap is too large for one size of rebar, then it will simply fall of the rebar. Another problem with the caps is that they are not reusable. Once a cap is used it is deformed in its interior. When it is removed, it cannot be reused because the fit does not provide enough friction to keep the cap on a rod. Given the number of rebar rods that are used throughout the world today, the cost of not being able to reuse the caps is substantial. Another problem with the caps is that they often fall off from the rods on which they are placed. For instance, the wind or jostling can cause caps to fall from the ends of rebar rods.

Accordingly, there is a need for a protective device that can be secured on protruding objects of differing size, which is reusable after it has been employed for a particular purpose, and which is secure when placed on the protruding object. The principles discussed herein will be discussed with respect to rebar rods, but they are applicable to other materials, such as poles, shafts, fence posts, axles, and they like. They can also be applied to tools, which have protruding parts. The following description is given for illustrative purposes only and should not limit the scope of the claims recited herein.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not constrained to limitations that solve any or all disadvantages noted in any part of this disclosure.

In one embodiment, a protective device is provided. A base member has a first surface adapted to face outward from the protruding object and a second surface adapted to face inward toward the protruding object. A first sidewall defines a space. The first sidewall includes a first end connected to the second surface of the base member, and a second end, which includes an opening adapted to receive the protruding object. The first sidewall extends perpendicularly from the base member. At least one fin is positioned within the first space and is connected to the first sidewall. The at least one fin extends inwardly from the first sidewall into the first space. A second sidewall defines a second space. The second sidewall is adapted to fit detachably over the second end of the first sidewall. At least one finger is positioned within the second space. The at least one finger is connected to and extends from the second sidewall into the second space.

In one embodiment, a base member is provided. The base member includes a first surface and a second surface. A sleeve has a first end connected to the second surface of the base member. A second end includes an opening adapted to receive a protruding object. The sleeve extends perpendicularly from the base member. At least one fin positioned within the sleeve and extending longitudinally toward the second end. The at least one fin is tapered such that it projects into the sleeve to a decreasing amount as it extends longitudinally toward the second end. An end cap is adapted to fit detachably over the second end of the sleeve. At least one finger is connected to the end cap that extends into the opening.

In one embodiment, the at least one finger comprises an arm portion that extends into the second space, and a shoulder portion that is connected to the second sidewall. In one embodiment, the protective device of claim 2, wherein arm portion has a first thickness and the shoulder portion has a second thickness that is greater than the first thickness. In one embodiment, the arm portion is adapted to engage with a bossing element located on the protruding object. In one embodiment, the shoulder portion is adapted to abut the second end of the first sidewall. In one embodiment, a ridge is positioned on an outer surface of the first sidewall. In one embodiment, a boss element is positioned on an inner surface of the second sidewall; wherein the boss element is configured to register with the ridge and secure the second sidewall to the first sidewall. In one embodiment, the ridge extends circumferentially around the outer surface of the first sidewall and the boss element extends circumferentially around the inner surface of the second sidewall. In one embodiment, the first sidewall is cylindrical and closed at the first end and open on the second end. In one embodiment, the second sidewall is cylindrical and open, except for the at least one finger, on a first end and a second end. In one embodiment, a steel reinforcing is positioned within first sidewall between the first end and the first space. In one embodiment, at least one finger comprises four fingers. In one embodiment, the end cap comprises an open ended cylinder having an interior surface and an exterior surface. In one embodiment, the four fingers extend equidistantly around the interior surface. In one embodiment, the at least one fin comprises eight fins. In one embodiment, the sleeve has a first boss and the end cap has a second boss in registration with the first boss to secure the end cap to the sleeve. In one embodiment, the sleeve is made from a hardened thermoplastic material and the end cap is made of a flexible thermoplastic material. In one embodiment, a steel reinforcing insert is over molded within the sleeve between the first end and an interior space defined by the sleeve. In one embodiment, the steel reinforcing insert has a dome shape.

BRIEF DESCRIPTION OF THE DRAWINGS

A more detailed understanding may be had from the following description, given by way of example in conjunction with the accompanying drawings wherein.

DETAILED DESCRIPTION

Figure 1:
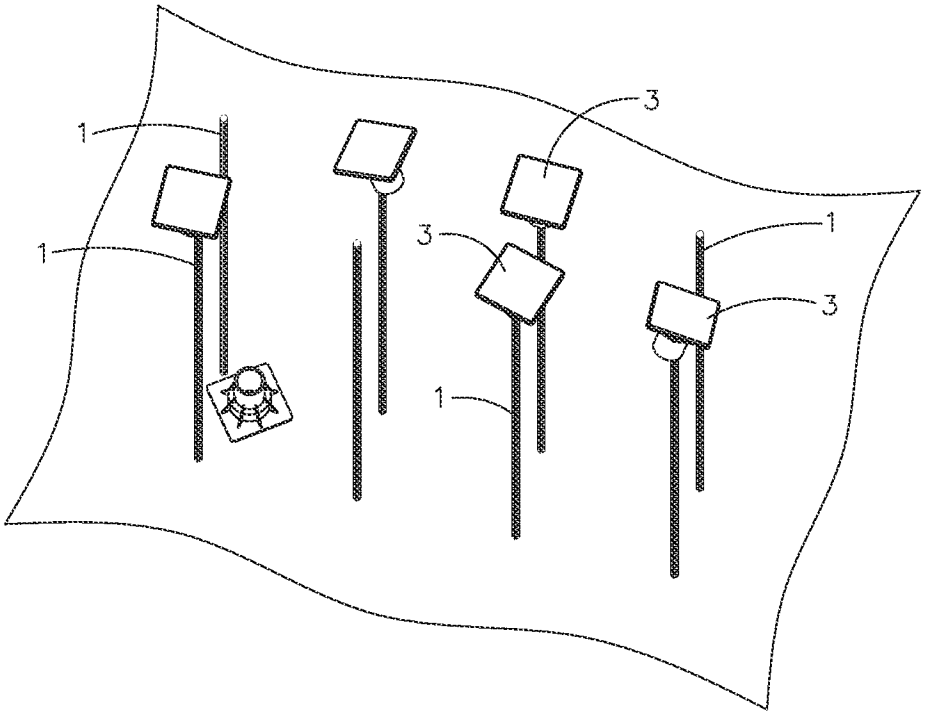
FIG. 1 (PRIOR ART)
FIG. 1 illustrates a plurality of rebar rods on which protective caps are placed.
Figure 2A:
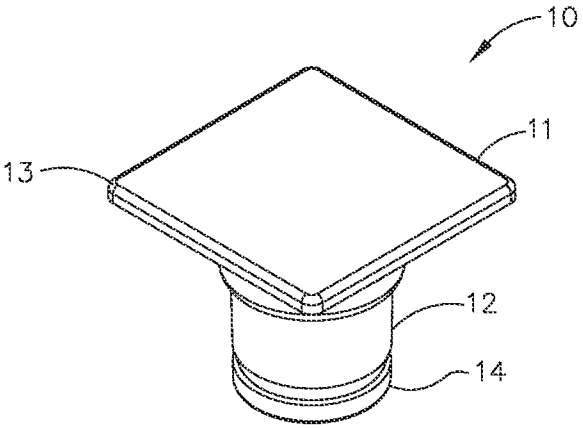
FIG. 2A is a perspective view of one example of a protective device that can be used with a protruding object in accordance with one embodiment of the present disclosure.
Figure 2B:
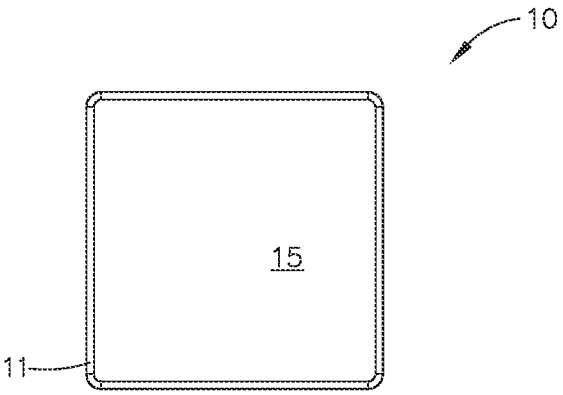
FIG. 2B is a top view of the protective device of FIG. 2A.
Figure 2C:
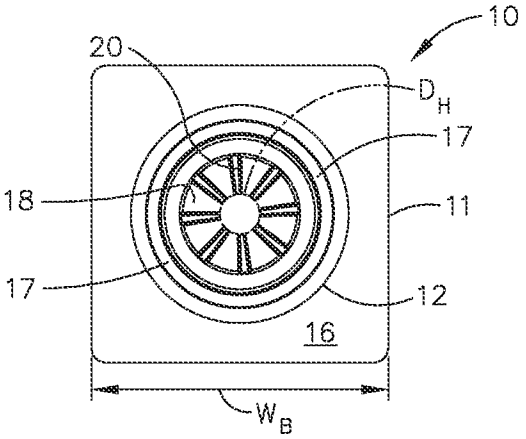
FIG. 2C is a bottom view of the protective device of FIG. 2A.

Referring to FIG. 2A, one embodiment of protective device 10 is shown for illustrative purposes. Protective device 10 in one example has base member 11, and a sleeve 12. Base member 11 resides at a first end 13 of the protective device. Sleeve 12 is attached to base member 11 and extends from the first end 13 and terminates at a second end 14. FIG. 2B shows a top view of the protective device 10 in which only a top surface 15 of the base portion 11 is shown. FIG. 2C shows a bottom view of the protective device 10 in which a bottom surface 16 of the base portion 11 is shown. Base member 11 in one example is a substantially flattened rectangular structure. In one example, base member 11 has four sides of length WB. Sleeve 12 comprises a sidewall, which defines an opening 17 through which a protruding object may be inserted. Further, as will be discussed herein, the sidewall of sleeve 12 defines a space 18 within which a protruding object may reside after it is inserted into opening 17. Within space 18, are a plurality of fins 20. Fins 20 are connected to the sidewall of sleeve 12 and extend radially into space 18. In one example, there are eight fins positioned equidistantly around the interior surface of sidewall defining sleeve. Fins 20 in one example are tapered and they extend longitudinally through sleeve toward opening 17. As a result, fins extend radially less into space 18, as they approach opening 17. As will be discussed further herein, fins 20 serve as a guide to center a protruding object during insertion into space 18. Fins 20 also due to their tapered profile allow objects of varying size to be placed within sleeve 12. For example, a rod of larger diameter will fit within space 18 but will not be able to travel as far longitudinally as a rod of lesser diameter. It should be noted that a greater or lesser number of fins 20 may be used.

Referring further to FIG. 2A, FIG. 2B, and FIG. 2C, base portion 11 is shown as a rectangular/square shape for illustrative purpose, but could be another shape, such as circular, oval, triangular, polygonal, etc. Sleeve 12 is shown as cylindrical, but could be another shape, such as those three-dimensional shapes having oval, polygonal, or triangular cross-sections. The function of sleeve 12 is to receive an end of an object, such as a rebar rod or pole. Fins 20 guide such a rod or pole and center it within space 18. Base member 11 provides a surface area, which would not impale a person or thing if one were to impact the object, due to the surface area of base portion 13 lacking a profile, which would cause puncturing.

Figure 2D:
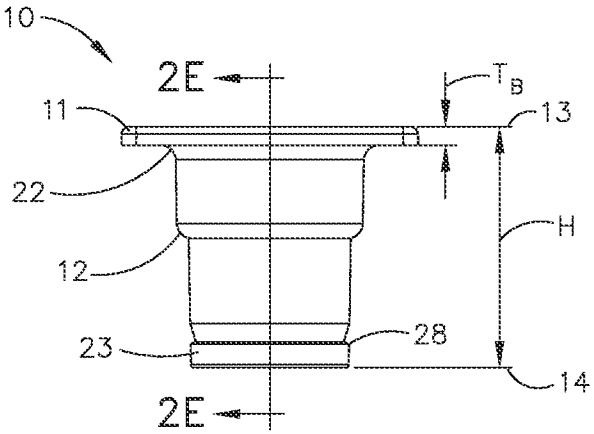
FIG. 2D is an elevated side view of the protective device of FIG. 2A.

Referring now to FIG. 2D, an elevated side view of protective device 10 is shown for illustrative purpose. In one example, protective device 10 has a height H, which extends from first end 13 to second end 14. Base member 11 in one example has a thickness of TB. Sleeve 12 in one example comprises a first end 22, which abuts base member 11. In one example, sleeve 12 tapers as it extends longitudinally from first end 22 to second end 23. In one example, sleeve 12 includes a ridge 28. Ridge 28 in one example may be used to connect an end cap (not shown) to sleeve 12, as will be further discussed herein.

Referring now to FIGS. 2A, 2B, 2C, and 2D, in one embodiment, base member 11 and sleeve 12 are formed by injection molding of thermoplastic. Accordingly, base member 11 and sleeve 12 are of a unitary construction. In another example, base member 11 and sleeve 12 are made separately and secured together with connectors or fasteners to form a unitary construction. Base member 11 and sleeve 12 operate as an integral whole to perform the functions described herein, but do not have to molded or fused together at the time of fabrication. Furthermore, they do not have to be made from the same material. Multiple materials of differing tolerances, weights, and strengths could be used in fabricating base member 11 and/or sleeve 12.

Figure 2E:
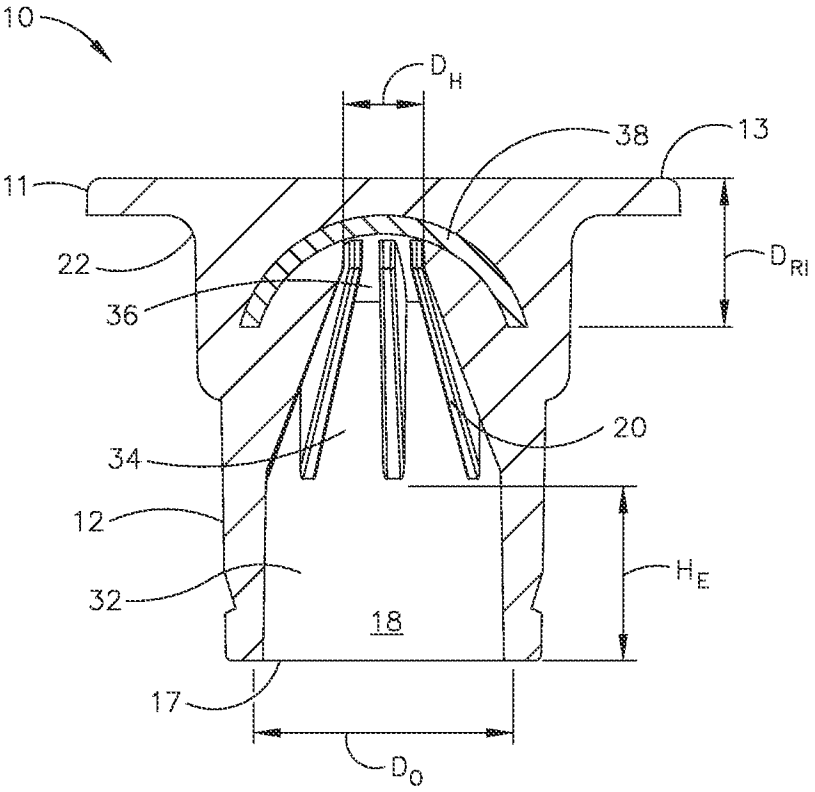
FIG. 2E is a sectional view taken along the line A-A shown in FIG. 2D.

Referring now to FIG. 2E, a sectional view, taken along line A-A of FIG. 2D, shown for illustrative purposes. Sleeve 12 includes opening 17, having a diameter $D_O$. The sidewall of sleeve portion 12 defines space 18. Space 18 in one example comprises an entry portion 32, an intermediate frustoconical portion 34, and a terminating portion 36. Entry portion 32 has a diameter $D_O$ and can receive rods of various sizes. Frustoconical portion 34 starts with diameter $D_O$ and tapers to the diameter $D_H$ of terminating portion 36. Fins 20 extend from a top end of terminating portion 36 and extend downward through frustoconical portion 34 and stop at the boundary between cylindrical portion 32 and frustoconical portion 34. Fins 20 in one example taper at an angle along the sidewall of frustoconical portion 34 as they extend longitudinally through space 18. In one example, fins 20 have a length of $L_{FI}$ In one example, entry portion 32 has a height equal to $H_E$. Accordingly, an object placed within space 18 would not encounter a fin 20, until it reached a depth of $H_E$. At a depth of $H_E$, fins 20 would begin to resist insertion of rods of larger diameters, whereas rods of smaller diameters would not meet resistance until they were inserted further into frustoconical portion 34. The smallest rod for which protective device is dimensioned would not meet resistance until reaching the end of terminating portion 36. In one example, fins 20 are manufactured with sufficient hardness to not deform when encountering an object, such as rebar. The angle along the fins 20 guides the object into the sleeve 12 as far as the outer diameter of the object, in correlation with the shape of the fins 20, allows. At this point, the object will stop. Therefore, the protective device 10 may be used on different sized objects, such as different sized rebar. The range of sizes for which protective device 10 may be designed can be varied by varying sizes of the dimensions set forth herein.

Referring further to FIG. 2E, in one embodiment, a reinforcing insert 38 is placed within second portion 23. Reinforcing insert 38 in one example is made of a material that different than the material used to make the rest of protective device. For example, reinforcing insert 38 may be made of a stronger material than the rest of protective device 10. In one example, reinforcing insert 38 may be made of steel, whereas the remainder of base portion 11 and sleeve 12 are made of thermoplastic material. In one embodiment, reinforcing insert 38 may be over-molded to attach it within sleeve 12 between first end 22 and terminating portion 36. In one embodiment, the function of reinforcing insert 38 is to impart additional strength to protective device 10. If an object, such as a rod were to be placed within space 18 and subjected to a force directed from the first end 13 or second end 14, reinforcing insert 38 would provide \ additional strength to prevent such an object from running through sleeve 12 and puncturing base portion 11. In one example, the depth from top end 13 of protective device 10 to the end of reinforcing insert 38 is $D_{RI}$.

Figure 3A:
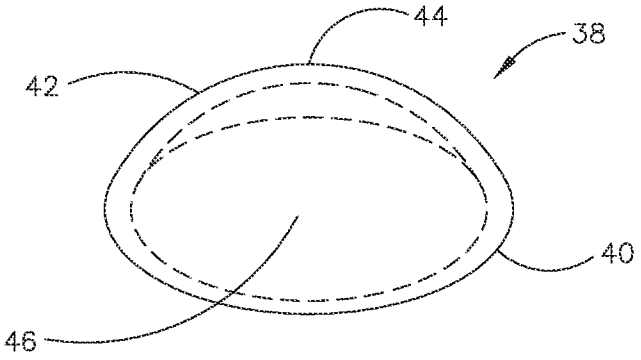
FIG. 3A is a perspective view of a reinforcing insert that can be used in the protective device of FIG. 2A.
Figure 3B:
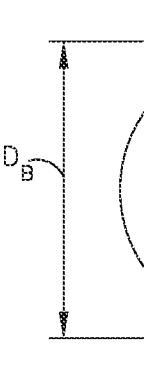
FIG. 3B is a bottom view of the reinforcing insert of FIG. 3A.
Figure 3C:
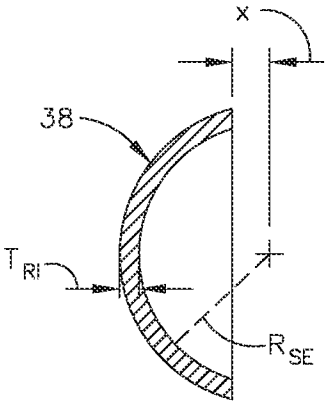
FIG. 3C is a section view taken along the line A-A shown in FIG. 3B.
Figure 4A:
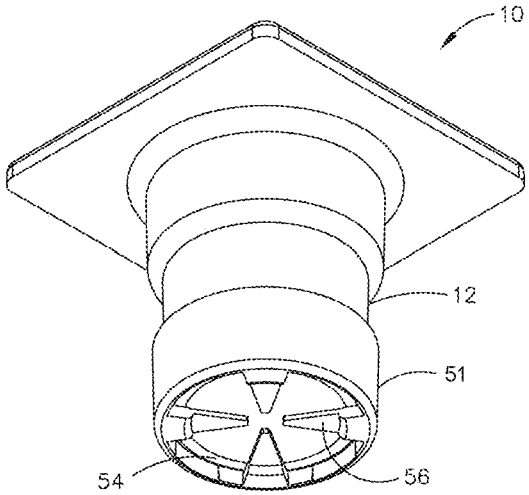
FIG. 4A is perspective view of one example of a protective device, which includes an end cap in accordance with one embodiment of the present disclosure.
Figure 4B:
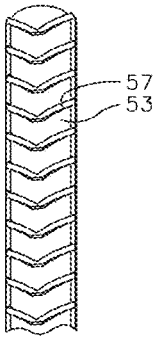
FIG. 4B is a perspective view of a portion of a rebar rod over which the protective device of FIG. 4A may be placed.

Referring to FIGS. 4A and 4B, an exemplary embodiment of reinforcing insert 38 is shown for illustrative purposes. Reinforcing insert 38 in one example comprises a base 40 with a sidewall 42 extending from the base 40 and reaching an apex 44 over the center 46 of the base 40. Referring to FIG. 3B and FIG. 3C, a bottom view and sectional view of reinforcing insert 38 is shown for illustrative purposes. In the embodiment, the base 40 is circular in cross section and has an outer diameter of $D_B$. The sidewall 42, in the embodiment, is arced and has a semicircular cross-section. In one embodiment, the base 40 and sidewall have a thickness of $T_{RI}$. In the embodiment shown, the cross-section of the sidewall 42 is a semi-circle with an inner radius of $R_{sw}$. The inner circumference of the cross-section is ($\pi$*$R_{SW}$−x) where x is a truncation of the circumference of a half circle with radius equal to $R_{SW}$.

Referring to FIG. 4A, a perspective view of an embodiment of protective device 10 with an end cap 51 installed on the second end 23 (FIG. 2D) of sleeve 12. The end cap 51 in one embodiment acts as support to keep safety device 10 concentrically on an object, such as a piece of rebar 53. The end cap 51 in one embodiment provides a retaining function to prevent the cap protective device 10 from falling off an object, such as rebar 53.

The end cap 51 in one example is made of a flexible material, such as flexible thermoplastic. In one example, end cap 51 comprises a sidewall 54 that is shaped like a cylinder. The end cap 51 includes one or more bendable fingers 56, which extend inward from sidewall 54 into a space defined by the end cap 51. When the protective device 10 is pushed onto an object, such as rebar rod 53, the bendable fingers 56 bend longitudinally upward (see arrow) following the movement of the rebar rod 53 into sleeve 12. When the bendable fingers 56 bend inward, they also push against the outer surface of the rod 53 and provide a frictional force that prevents protective device 10 from falling off rod 53 even if it is subjected to wind, movement, jostling or it is placed upside down. In the case of rebar 53, the fingers 56 act as a barbed hook against the bossing 57 of the rebar 53 and provide an additional securement mechanism. Because the end cap 51 is made of flexible material, it is possible that it may deform after a certain amount of use. However, because it can be easily removed from the protective device 10, it can be replaced without replacing the entirety of the protective device 10.

Figure 4C:
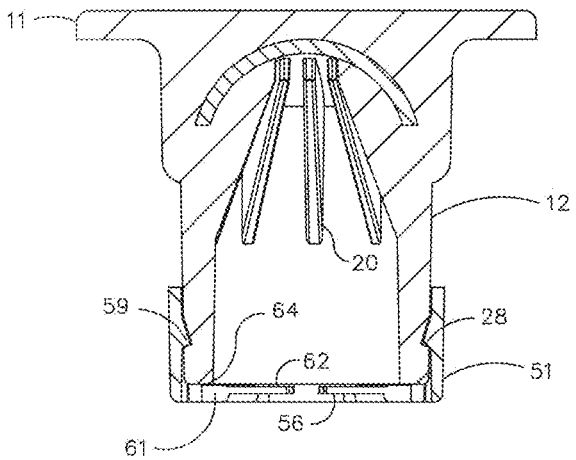
FIG. 4C is a sectional view of the protective device, including the end cap shown in FIG. 4B.

Referring to FIG. 4C, in one example, the end cap 51 is mounted to the sleeve 12 by an internal boss feature 59 which is projects inward into the space defined by end cap 51 from sidewall 54. Boss feature registers with ridge 28 (FIG. 2D) located on the outside of the sleeve 12. In one example, finger 56 includes a shoulder 61 and an arm 62. In one example, shoulder 61 is thicker than arm 62. In one example, arm 62 has a thickness $T_{FA}$ and shoulder 61 has a thickness of $T_{FS}$. Arm 62 engage with rebar rod 53 and shoulder 61 helps secures end cap 51 to sleeve 12 by being positioned flush and mating with an opposing edge 64 of sleeve 12.

Figure 5A:
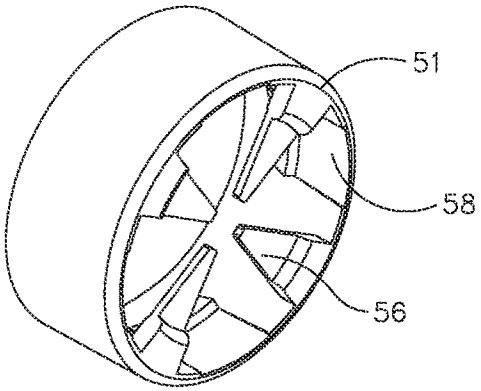
FIG. 5A is a perspective view of the end cap shown in FIG. 4A.
Figure 5C:
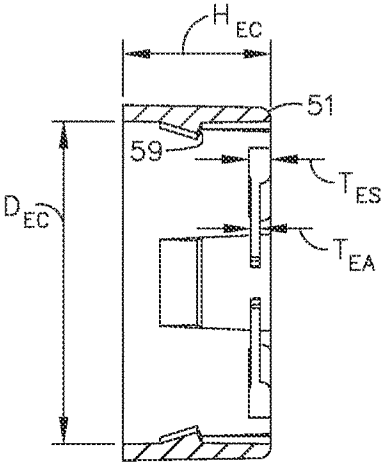
FIG. 5C is a sectional view taken along line A-A of FIG. 5B.
Figure 5B:
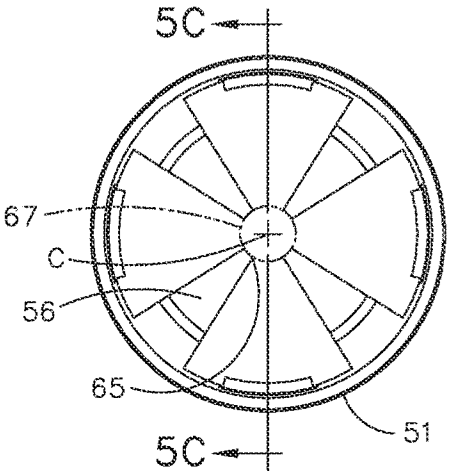
FIG. 5B is top view of the end cap shown in FIG. 5A.

Referring to FIG. 5A and FIG. 5B, end cap 51 in one example has a circular shape and an outer diameter $D_{EC}$. The fingers 56 extend inward from sidewall 58 and are located concentrically within the end cap 51. This allows to allow protective device 10 to be placed concentrically and even over and around an object, such as a rod.

The ends 65 of the fingers 56 terminate just short of the center C of cylinder defining end cap 51. The space defined by ends 65 of the fingers 56 in one embodiment can accommodate an imaginary circular space 67, which is centered around C and has a diameter of $D_F$. An object can be inserted through space 67 into the space 18 of sleeve 12.

Referring to FIG. 5C, a sectional view of FIG. 5B, is taken along line A-A for illustrative purposes. The section view demonstrates that in one example, end cap has a height $H_{EC}$, and an inner diameter of $D_{EC}$.

Below are a table of example values for the dimensions described herein. The values should not be construed as limiting, but serve to provide examples of values, which would allow protective device 10 to function with objects, such as rebar, of various sizes and diameters. The values may be scaled up or scaled down in accordance with the range of objects that the protective device is employed with. In addition, the units used are inches, but other units could be used by maintaining the proportions described herein.

| | |
|---|---|
| $W_B$ | 4.00 |
| H | 3.25 |
| $T_B$ | 0.25 |
| $D_O$ | 1.63 |
| $D_H$ | .56 |
| $L_{FI}$ | 1.61 |
| $H_E$ | 1.22 |
| $D_B$ | 1.94 |
| $T_{RI}$ | .13 |
| X | .25 |
| $D_{FC}$ | 2.18 |
| $D_F$ | 0.38 |
| $H_{EC}$ | 1.00 |
| $T_{FA}$ | 0.04 |
| $T_{FS}$ | 0.15 |
| $D_{RI}$ | 1.25 |

In describing preferred examples of the subject matter of the present disclosure, as illustrated in the Figures, specific terminology is employed for the sake of clarity. The claimed subject matter, however, is not intended to be limited to the specific terminology so selected, and it is to be understood that each specific element includes all technical equivalents that operate in a similar manner to accomplish a similar purpose.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A protective device to reduce risk of injury from a protruding object, comprising:

a base member having a first surface adapted to face outward from the protruding object and a second surface adapted to face inward toward the protruding object;

a first sidewall defining a first space, the first sidewall including a first end connected to the second surface of the base member, and a second end, which includes an opening adapted to receive the protruding object, wherein the first sidewall extends perpendicularly from the base member;

a second sidewall defining a second space, wherein the second sidewall is adapted to fit detachably over the second end of the first sidewall; and at least one finger positioned within the second space, wherein the at least one finger is connected to and extends from the second sidewall into the second space.

2. The protective device of claim 1, wherein the at least one finger comprises an arm portion that extends into the second space, and a shoulder portion that is connected to the second sidewall.

3. The protective device of claim 2, wherein the arm portion has a first thickness and the shoulder portion has a second thickness that is greater than the first thickness.

4. The protective device of claim 2, wherein the arm portion is adapted to engage with a bossing element located on the protruding object.

5. The protective device of claim 2, wherein the shoulder portion is adapted to abut the second end of the first sidewall.

6. The protective device of claim 1, further comprising:

a ridge positioned on an outer surface of the first sidewall; and a boss element positioned on an inner surface of the second sidewall; wherein the boss element is configured to register with the ridge and secure the second sidewall to the first sidewall.

7. The protective device of claim 6, wherein the ridge extends circumferentially around the outer surface of the first sidewall and the boss element extends circumferentially around the inner surface of the second sidewall.

8. The protective device of claim 1, wherein the first sidewall is cylindrical and closed at the first end and open on the second end.

9. The protective device of claim 1, wherein the second sidewall is cylindrical and open, except for the at least one finger, on a first end and a second end.

10. The protective device of claim 1, further comprising a steel reinforcing insert, which is positioned within the first sidewall between the first end and the first space.

11. A protective device, comprising:

a base member having a first surface and a second surface;

a sleeve, having a first end connected to the second surface of the base member, and a second end, which includes an opening adapted to receive a protruding object, wherein the sleeve extends perpendicularly from the base member;

an end cap that is adapted to fit detachably over the second end of the sleeve; and at least one finger connected to the end cap that extends into the opening.

12. The protective device of claim 11, wherein the at least one finger comprises four fingers.

13. The protective device of claim 12, wherein the end cap comprises an open ended cylinder having an interior surface and an exterior surface.

14. The protective device of claim 13, wherein the four fingers extend equidistantly around the interior surface.

15. The protective device of claim 11, wherein the sleeve has a first boss and the end cap has a second boss in registration with the first boss to secure the end cap to the sleeve.

16. The protective device of claim 15, wherein the sleeve is made from a hardened thermoplastic material and the end cap is made of a flexible thermoplastic material.

17. The protective device of claim 16, further comprising a steel reinforcing insert that is over molded within the sleeve between the first end and an interior space defined by the sleeve.

18. The protective device of claim 17, wherein the steel reinforcing insert has a dome shape.

* * * * *